US005112288A

United States Patent [19]

Ulrich et al.

[11] Patent Number: 5,112,288

[45] Date of Patent: May 12, 1992

[54] CARTON ERECTOR APPARATUS

[75] Inventors: Lawrence W. Ulrich; Conrad Walker, both of Darien, Ill.

[73] Assignee: Durable Packaging Corp., Chicago, Ill.

[21] Appl. No.: 638,075

[22] Filed: Jan. 7, 1991

[51] Int. Cl.[5] ..... B31B 1/76; B31B 1/80

[52] U.S. Cl. ..... 493/27; 493/183; 493/316

[58] Field of Search ..... 493/27, 313, 315, 316, 493/317, 183

[56] References Cited

U.S. PATENT DOCUMENTS

| | | | |
|---|---|---|---|
| Re. 27,361 | 5/1973 | Berney | 93/53 |
| 4,070,952 | 1/1978 | Linner | 493/27 |
| 4,285,679 | 8/1981 | Wahle | 493/125 |
| 4,632,666 | 12/1986 | Ulrich | 493/316 |
| 4,892,513 | 1/1990 | Kwiek | 493/316 |
| 4,917,659 | 4/1990 | Mohaupt | 493/316 |

*Primary Examiner*—Bruce M. Kisliuk
*Assistant Examiner*—Jack Lavinder
*Attorney, Agent, or Firm*—Dressler, Goldsmith, Shore, Sutker & Milnamow, Ltd.

[57] ABSTRACT

A carton erector apparatus for setting up foldable carton blanks. The apparatus includes a carton blank storage section, a carton blank setup section and a bottom flap folding section. A carriage assembly delivers a setup carton from the setup section into the bottom flap folding section. Means is provided to selectively control the distance that the carriage assembly travels into the bottom flap folding section during each cycle.

5 Claims, 6 Drawing Sheets 10
14
18

64
66
68
54
62
42
75
84
48
90
82
86
88
88
82
90
86
84
70
46
136
74
78
72
124
76
80
130
122
58
120
82
128
126
62
86
60
54
44
75
90
84
18
95
92
94
112
59
98
100
117
96
18
34
18

CARTON ERECTOR APPARATUS

BACKGROUND OF THE INVENTION

This invention relates to carton erecting apparatus for setting up foldable carton blanks having side and end panels and top and bottom flaps integral therewith and, more particularly, to apparatus for setting up carton blanks which are supplied to the apparatus in knocked-down form, and subsequently folding their bottom flaps.

Conventional fordable shipping containers of the rectangular four-flap type are typically manufactured from a single piece of cardboard, corrugated board, or the like cut into a predetermined pattern and provided with indented fold lines to facilitate folding into a rectangular carton. The manufacturer usually folds the cardboard pattern once to bring opposite edges together and then joins these two edges, such as with a strip of adhesive tape for example, to thereby form what is commonly known as a "manufacturer's joint". When the carton is set up for use, the manufacturer's joint is at a corner defined by the meeting of an end panel and a side panel of the carton.

The carton manufacturer ships the carton blank in this compact form, each carton blank being a sheet of corrugated board folded in half and having the free ends joined by a manufacturer's joint. This compact folded configuration is designated in the art, and in the following specification and claims, by the term "knocked-down". Upon receipt by the user, each carton must be set up by opening it to a rectangular shape and then folding the bottom flaps inwardly to a closed position. The bottom flaps are then typically maintained in the closed position by gluing, by a strip of gummed or pressure-sensitive tape, or by stapling. The present invention is directed toward apparatus for setting up four-flap fordable cartons of the type known as RSC (regular slotted carton), HSC (half slotted carton), half telescope and the like.

The previously known apparatus designed for setting up and closing the bottom of such carton blanks, which are supplied as a knocked-down or collapsed tubularly formed carton or carton blank having side panels and bottom flaps and top flaps which are integral with the said sides, comprises a support which carries a magazine for the carton blanks, a feeding unit for pulling out and feeding a carton blank and a bottom closing means for folding in and possibly sealing the bottom flaps before the carton is filled. The feeding unit comprises a pneumatically acting catcher that is mounted perpendicularly to the feeding path and it is extendable so as to be able to catch a carton blank, pull same out of the magazine and together with the carton blank move along a feeding path while the carton is set up to tubular form and the bottom flaps are infolded. At this stage the catcher is disengaged from the carton and moves back to catch another carton. In the previously known apparatus there is a first linear motion towards and away from the magazine to grasp and set up the carton and a second linear motion perpendicular to the first linear motion to deliver the set-up carton from the apparatus. These two linear motions necessitate a substantial increase in the exterior dimensions of the apparatus. Examples of such apparatus are disclosed in U.S. Pat. No. Re. 27,361 and U.S. Pat. No. 4,285,679.

The present invention is an alternative embodiment and specifically improves upon the carton erecting apparatus disclosed in U.S. Pat. Nos. 4,632,666 and 4,892,513, which patents have the same assignee as the present invention. The carton erecting apparatus disclosed in these patents includes a carton blank storage section, a carton setup section and a bottom flap folding section. The carton blank storage section includes a magazine for storing and urging knocked-down carton blanks in a substantially vertical orientation towards the carton setup section.

The carton setup section includes a carton opening assembly mounted therein. The carton opening assembly has a folding arm assembly and a pivot arm assembly. The folding arm assembly is pivotal about a substantially vertical shaft secured to a carriage plate and is movable between a first position generally parallel to the side panel of the forward carton blank in the magazine assembly and a second position generally perpendicular to the side panel of the carton. The pivot arm assembly is pivotally secured to the folding arm assembly and is movable between a first position substantially parallel to the folding arm assembly and a second position substantially perpendicular to the folding arm assembly.

A grasping means including at least one suction cup is secured to the pivot arm assembly for grasping the side panel of the forward carton blank from the magazine arrangement when the pivot arm assembly and the folding arm assembly are in their first positions. Subsequent movement of the pivot arm assembly and the folding arm assembly into their second positions is effective to set up the carbon blank into a tubular form with an end panel thereof in contact with the folding arm assembly.

The bottom flap folding means includes a flap kicker assembly pivotally mounted within the carton setup section for infolding the trailing bottom end flap of the setup carton. A longitudinally extending plough member and a pair of converging side plough bars are mounted in the bottom flap folding section for respectively infolding the leading bottom end flap and the bottom side flaps of the setup carton as the carton travels through the bottom flap folding section.

A carriage assembly is mounted in the bottom flap folding section for movement in a direction transverse to the direction of movement of the carton blanks in the carton blank storage assembly. The carriage assembly is movable between a first position within the bottom flap folding section and a second position extending into the carton setup section. A longitudinally extending plough member is mounted on the carriage assembly and movable therewith for infolding the leading bottom end flap of a setup carton in the carton setup section as the carriage assembly moves into its second position.

A pair of spaced-apart carton receiving assemblies is mounted to the carriage assembly and movable therewith one on either side of the plough member. These assemblies include a plurality of longitudinally spaced roller members for grasping the side panels of a setup carton in the carton setup section as the carriage assembly moves into its second position and the delivery of same to the bottom flap folding section as the carriage assembly returns to its first position. A pair of converging side plough bars is mounted within the bottom flap folding section for infolding the bottom side flaps as the carriage assembly returns to its first position.

In the carton erecting apparatus disclosed in U.S. Pat. No. 4,892,513, additional grasping means are provided for grasping both of the side panels and an end panel to cradle the carton on three sides and keep it square during the erection thereof. A first suction cup assembly is mounted to the pivot arm assembly for grasping a side panel, a second suction cup assembly is mounted to the folding arm assembly for grasping an end panel and third suction cup assembly is mounted to the folding arm assembly for grasping the other side panel. The second suction cup assembly is mounted generally along the longitudinal center line of the carton setup section. The third suction cup assembly is mounted so as to permit transverse adjustment thereof depending upon the width of the carton being erected.

SUMMARY OF THE INVENTION

In accordance with a preferred embodiment of the present invention, a carton erecting apparatus is provided that includes a carton blank storage section, a carton setup section and a bottom flap folding section similar in construction and operation to that disclosed in U.S. Pat. No. 4,892,513. In the present invention, means is provided to selectively control the distance that the carriage assembly travels into the bottom flap folding section during each cycle.

More specifically, the longitudinal position of the switch means that controls the outward movement of the carriage assembly into the bottom flap folding section and means to stop movement of the carriage assembly are selectively adjustable to control the distance that the carriage assembly travels into the bottom flap folding section. The erector is also provided with longitudinally extending conveyor assemblies that are spaced apart to control the side panels of a setup carton and deliver the carton to a means for folding and sealing the bottom flaps. The conveyor assemblies are mounted so as to permit transverse and longitudinal adjustment thereof to accommodate different size cartons. By adjusting the distance the carriage assembly travels and the positioning of the conveyor assemblies, the distance which the carriage assembly travels during each cycle can be optimized for cartons having varying lengths. In so doing, it will not be necessary for the carriage assembly to travel the same distance for a short carton as it must travel for a long carton.

DESCRIPTION OF A PREFERRED EMBODIMENT

Figure 1A:
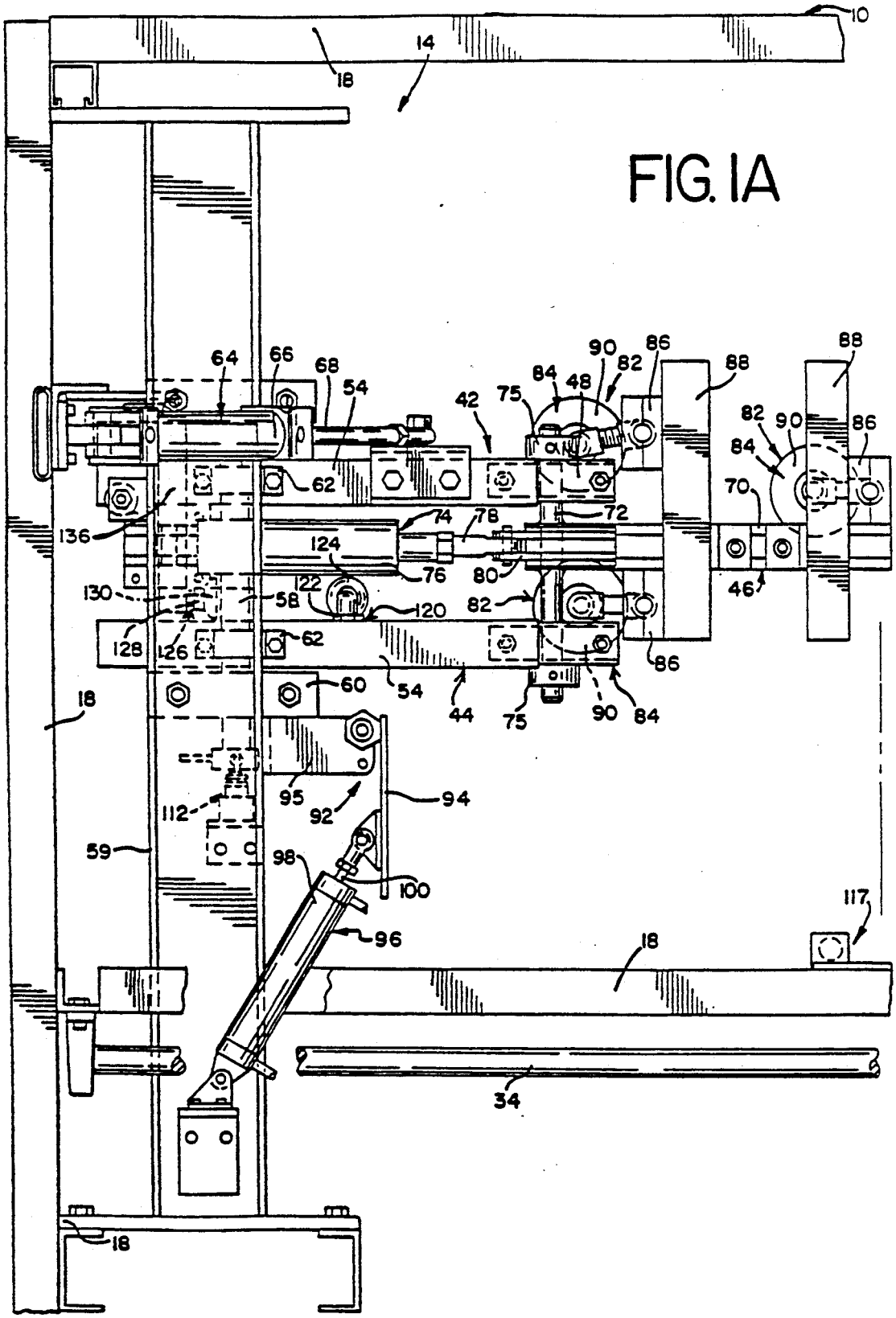
FIGS. 1A and 1B are elevational views respectively of the left end portion and the right end portion of a carton erector constructed in accordance with a preferred embodiment of the invention, with the folding arm assembly and the pivot arm assembly shown in their first positions in FIG. 1A and the carriage assembly shown in its first position in FIG. 1B.

The drawings show various views of a preferred embodiment of a carton erector apparatus indicated generally at 10. In order to facilitate the description of the apparatus 10, the apparatus may be functionally divided into a carbon blank storage or magazine section 12, a carton setup section 14 and a bottom flap folding section 16. The sections 12, 14 and 16 are mounted on a suitable frame structure indicated generally at 18. Referring to FIGS. 1A, 1B, 2A, 2B and 3, the carton blank storage section 12 extends out from one side of the frame structure 18 whereas the carton setup section 14 and the bottom flap folding section are within the frame structure 18.

The carton blank storage section 12 includes a suitable magazine assembly 20 for supporting and individually feeding the carton blanks 2 into the carton setup section 14. Magazine assembly 20 in a conventional manner includes inclined bottom guides 24 and side guides 26 for supporting the carton blanks 22 in a substantially vertical position. A suitable counterweight (not shown) is typically provided to urge the carton blanks towards the carton setup section 14.

Referring to FIGS. 1A, 1B, 2A, 2B and 3, the carton setup section 14 is located in facing relationship to the magazine assembly 20 for receipt of knocked-down carton blanks 22 thereinto.

A carton blank opening assembly 42 is mounted to frame structure 18 within section 14 for receiving a knocked-down carton blank from the magazine assembly 20 and opening the carton blank into an open tubular form for subsequent delivery to the bottom flap folding section 16. Assembly 42 includes a folding arm assembly 44 and a pivot arm assembly 46.

Figure 2A:
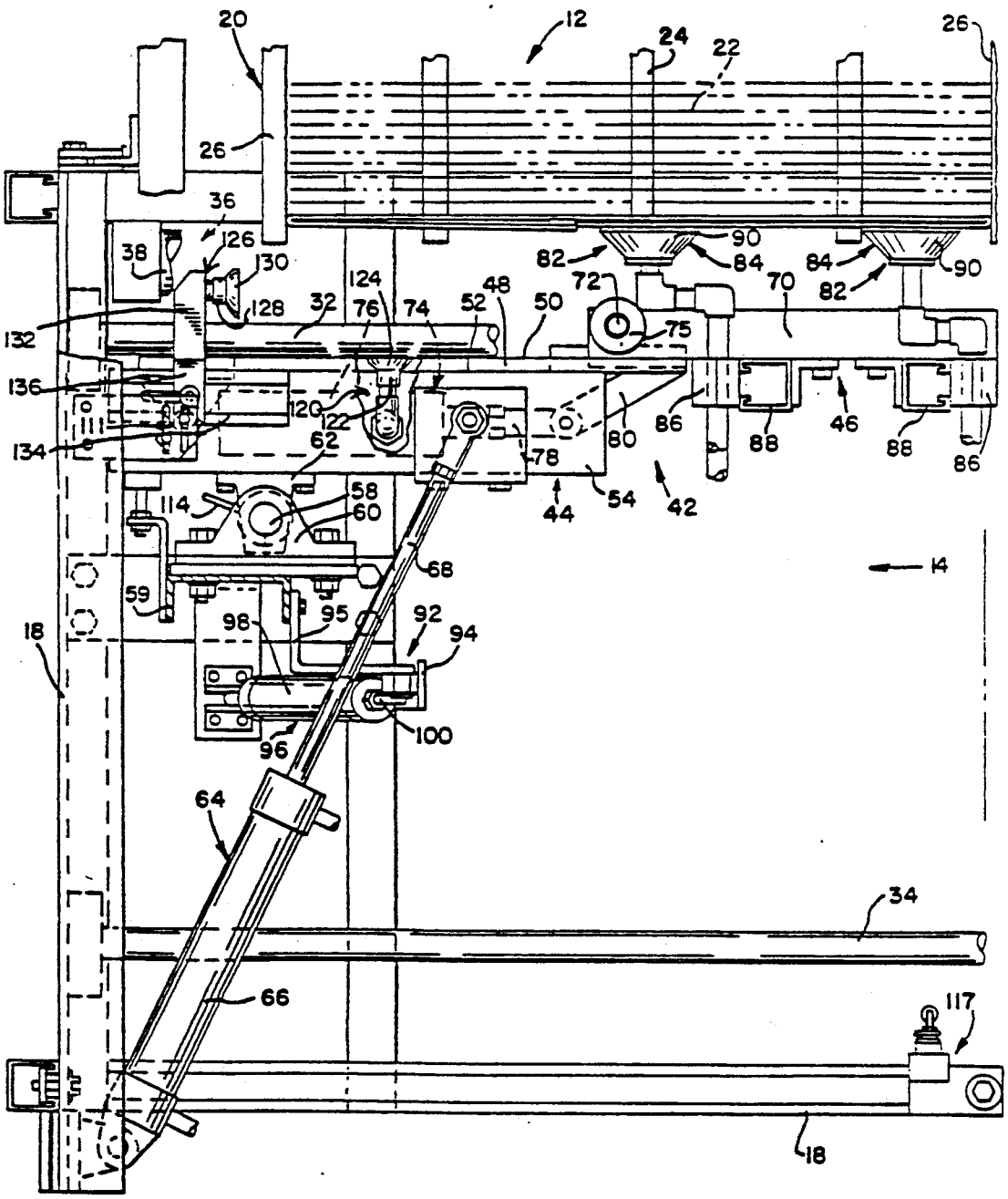
FIGS. 2A and 2B are top plan views respectively of the left end portion and the right end portion of the carton erector respectively as shown in FIGS. 1A and 1B.
Figure 3:
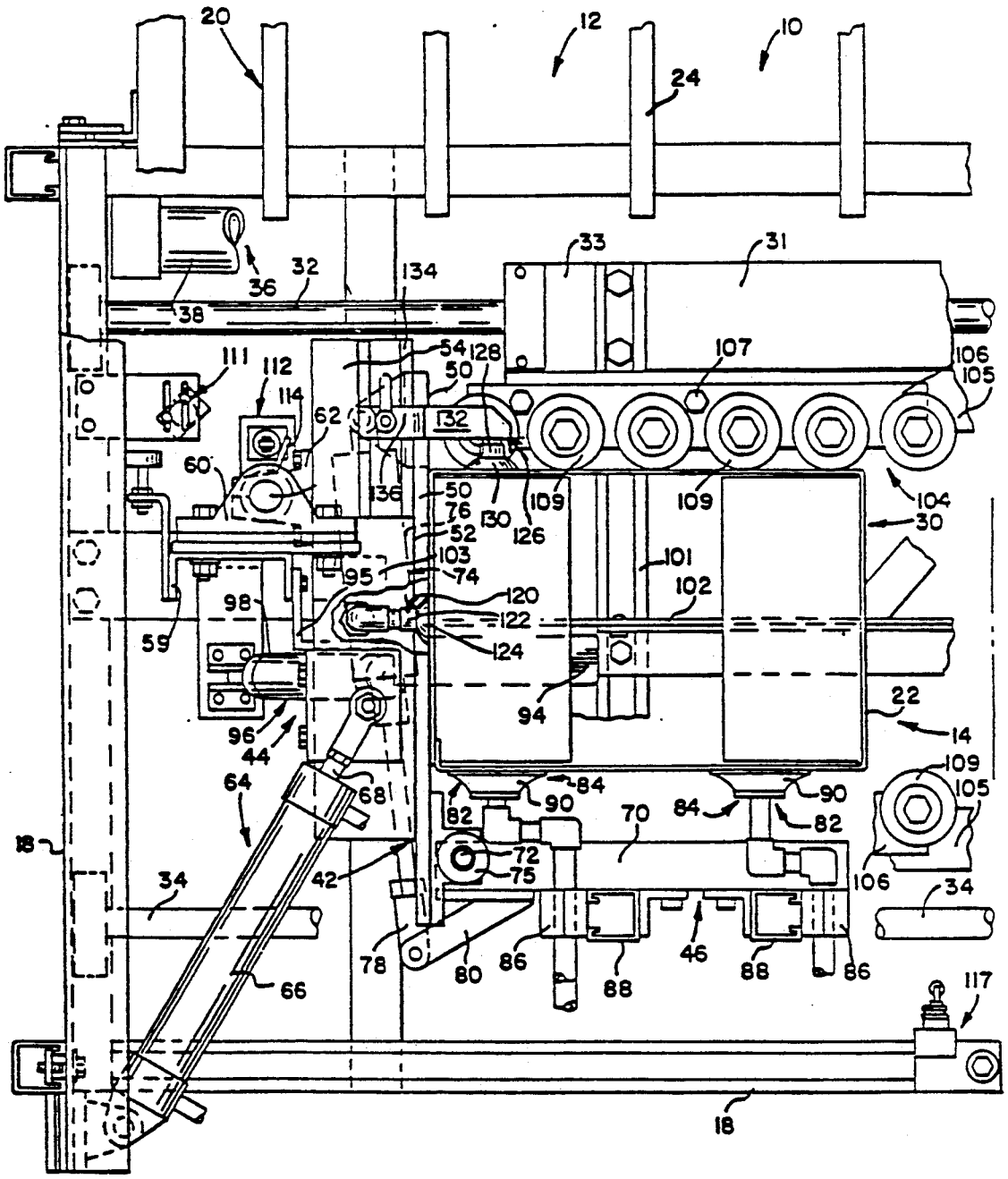
FIG. 3 is a partial top plan view of the carton erector as shown in FIGS. 2A and 2B, with the folding arm assembly and pivot arm assembly shown in their second positions and the carriage assembly shown in its second position.

Folding arm assembly 44 includes a folding arm or plate 48 having a vertically extending front surface 50 and a rear surface 52, which is slidably secured to a pair of vertically spaced-apart channel-shaped support members 54 by securing means (not shown) extending therethrough and into members 54. Support members 54 are suitably secured to a vertically extending shaft 58, which in turn is suitably rotatably secured to a vertically extending rigid frame member 59 through a pair of vertically spaced bearing members 60. Shaft 58 extends through upper and lower clamp members 62 respectively secured to the support members 54. The pivotal movement of the folding arm assembly 44 about the vertical axis through shaft 58 is preferably controlled by a pneumatic folding arm cylinder and piston assembly 64, wherein the cylinder portion 66 is secured to the frame structure 18 and the piston portion 68 is suitably secured to upper support member 54. The extension and retraction of piston portion 68 is effective to respectively pivot folding arm assembly 44 between a first position wherein the front surface 50 is generally parallel to a side panel of the forward knocked-down carton blank in the magazine assembly 20, as seen in FIGS. 1A and 2A, and a second position wherein the front surface 50 is generally perpendicular to such side panel, as seen in FIG. 3.

Pivot arm assembly 46 includes a generally horizontally extending channel-shaped pivot arm member 70 that is pivotally secured at the inner end thereof to folding arm 48 of folding arm assembly 44. The inner end of pivot arm 70 is secured to a vertical shaft 72 which in turn is rotatably received in upper and lower bearings 75 secured to surface 50 of folding arm 48. The pivotal movement of the pivot arm 70 about a vertical axis through shaft 72, relative to the folding arm assembly 44, is preferably controlled by a pneumatic pivot arm cylinder and piston assembly 74, wherein the cylinder portion 76 is suitably pivotally secured to the inner end of pivot arm 70 through a pair of crank plates 80 secured to pivot arm 70. The retraction and the extension of the piston portion 78 is effective to respectively pivot arm 70 between a first position substantially parallel to folding arm 48, as seen in FIGS. 1A and 2A, and a second position substantially perpendicular to folding arm 48, as seen in FIG. 3.

A first suction cup assembly 82 is mounted to pivot arm 70 for movement therewith. Assembly 82 includes suction cup members 84 that are in communication with a source of vacuum (not shown). Suction cup members 84 are secured to a bracket 86, which in turn is secured to a substantially vertical channel member 88 secured to pivot arm 70. Suction cup members 84 are preferably vertically adjustable through the selective positioning of bracket 86 within channel member 88. Suction cup members 84 are preferably horizontally adjustable through the selective positioning of channel member 88 relative to pivot arm 70. The suction cup portions 90 of suction cup member 84 extend forward of channel member 70 toward the forward carton blank in the magazine assembly 20 when the pivot arm 70 is in its first position such that upon the application of vacuum thereto the suction cup portions 90 grasp the side panel of the carton blank.

A second suction cup assembly 120 is mounted to an intermediate section of lower support member 54 of folding arm assembly 44. Assembly 120 includes a suction cup member 122, which is in communication with a source of vacuum (not shown), having a suction cup portion 124 facing in the same direction and in the same vertical plane as the front surface 50 of plate 48. Suction cup assembly 120 is preferably located on member 54 generally along the longitudinal centerline of the carton setup section 14.

A third suction cup assembly 126 is mounted to an outer portion of upper support member 54. Assembly 126 includes a suction cup member 128, which is in communication with a source of vacuum (not shown), having a suction cup portion 130 positioned in facing relationship to suction cup member 84 when pivot arm 70 is in its second position, as seen in FIG. 3. Suction cup member 128 is secured to a bracket 132, which in turn is secured to a substantially horizontal channel member 134 secured to upper support member 54 through a bracket 136. Suction cup member 128 is preferably horizontally adjustable through the selective positioning of bracket 136 relative to channel member 134, as best seen in FIG. 3.

A bottom flap kicker assembly 92 is pivotally mounted within the carton setup section 14. Kicker assembly 92 includes a kicker plate 94 that is pivotally mounted to a bracket 95, which in turn is secured to frame member 59. Kicker plate 94 is preferably controlled by a pneumatic kicker cylinder and piston assembly 96, wherein the cylinder portion 98 is pivotally secured to the kicker plate 94. It is readily apparent that the extension and retraction of the piston portion 100 is effective to respectively move the kicker plate 94 between a substantially vertical first position, as seen in FIGS. 1A and 2A, and a substantially horizontal second position to infold the trailing bottom end flap of a carton, as seen in FIG. 3.

Bottom flap folding means are provided to infold the bottom side flaps and the leading bottom end flap of a setup carton and a carriage assembly 30 is provided for receipt and delivery of a setup carton from the setup section 14 into the bottom flap folding section 16.

Figure 1B:
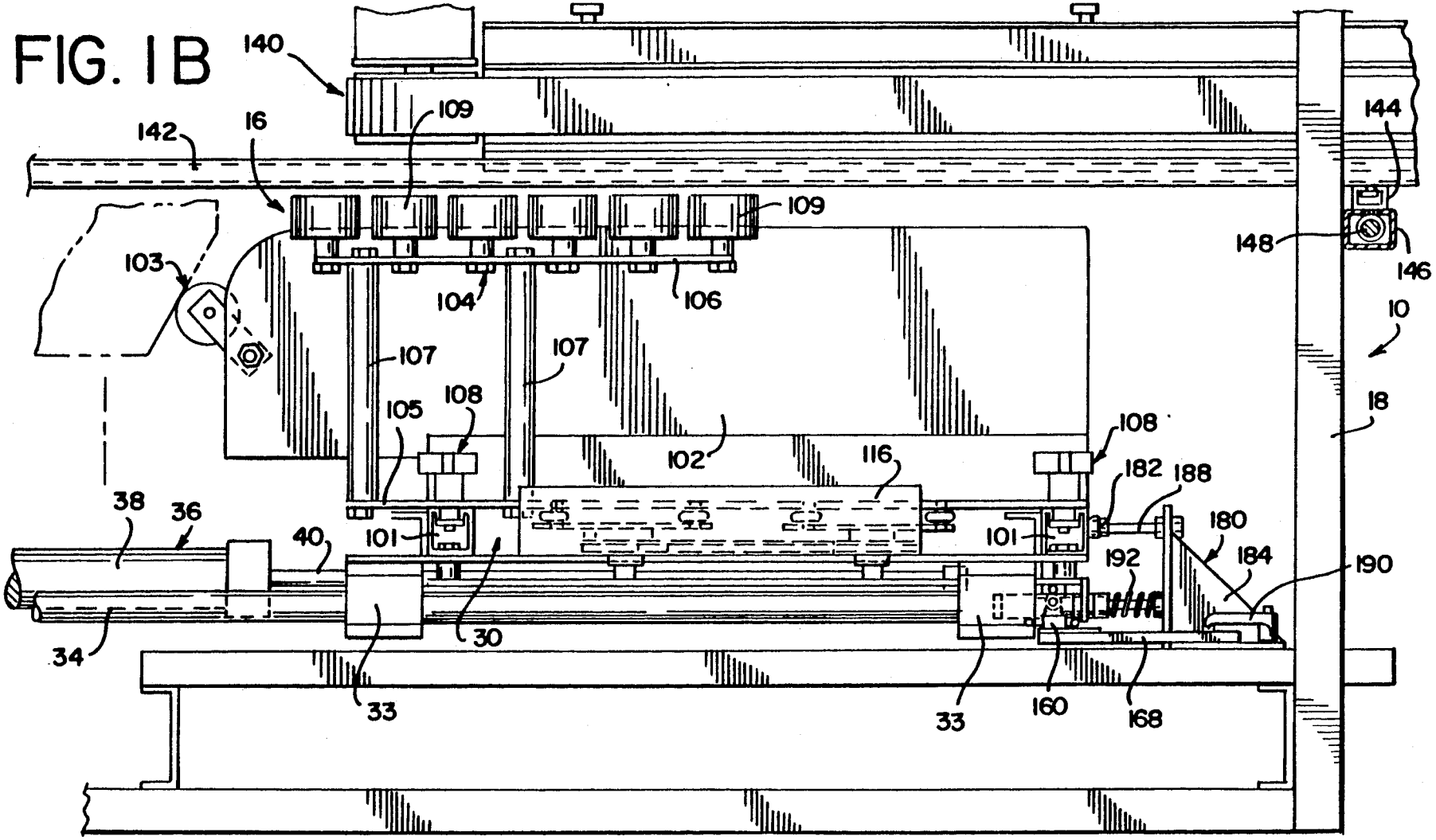
Figure 2B:
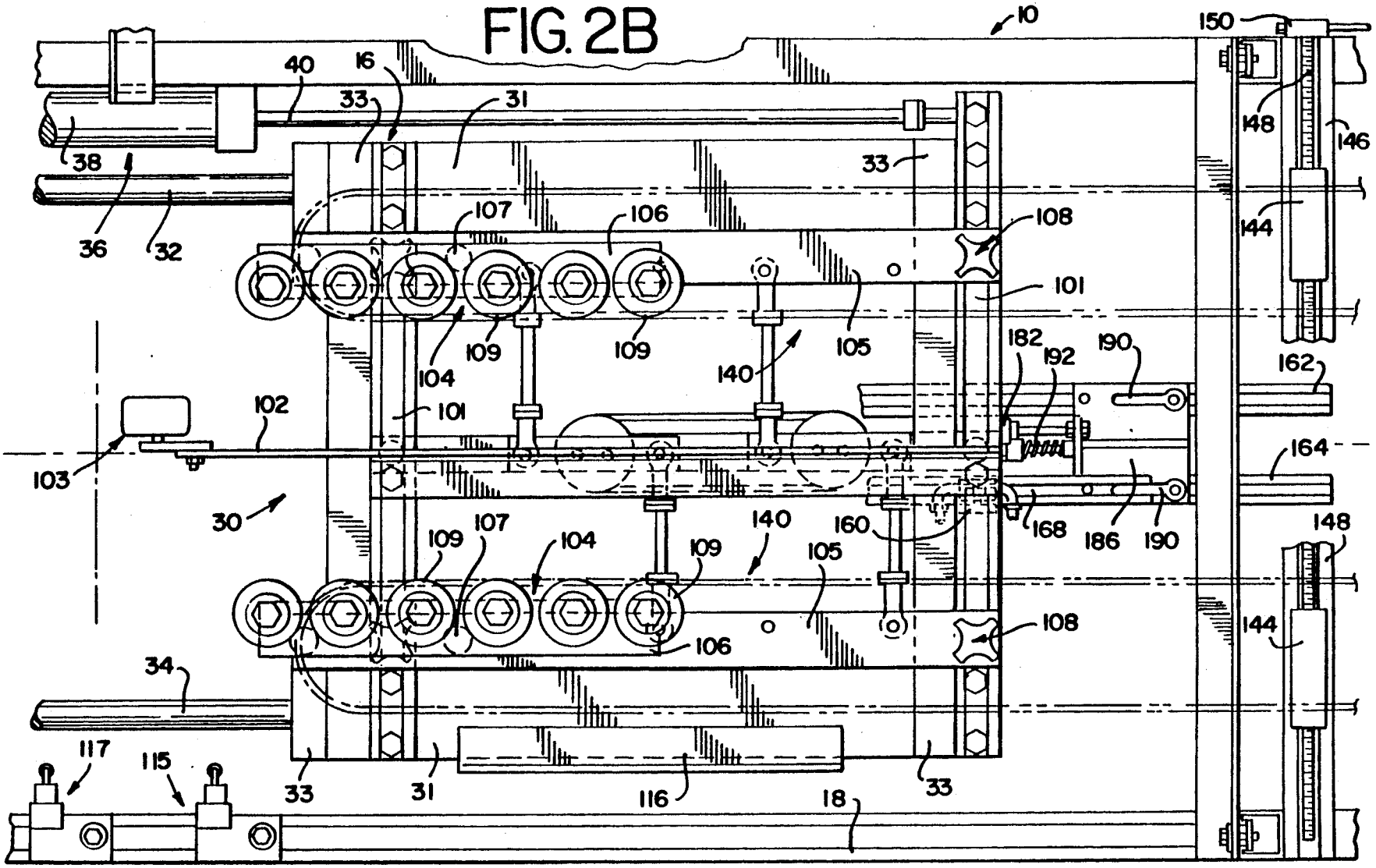

Carriage assembly 30 is mounted within a lower portion of the frame structure 18 for movement in a direction transverse to the direction of movement of the carton blanks in the magazine assembly 20. Carriage assembly 30 comprises a pair of transversely spaced carriage plates 31 suitably mounted on bearing blocks 33 for sliding movement along guide shafts 32 and 34 rigidly secured in place to frame structure 18. The movement of carriage assembly 30 is preferably controlled by a pneumatic carriage cylinder and piston assembly 36, wherein the piston portion 40 is suitably secured to the underside of one of the carriage assemblies 30 and the cylinder portions 38 are secured to the frame structure 18. The retraction and extension of the piston portion 40 is effective to respectively move the carriage plate 30 between a first position within the bottom flap folding section 16, as best seen in FIGS. 1B and 2B, and a second position extending into the carton setup section 14, as best seen in FIG. 3.

A pair of longitudinally spaced transverse channel members 101 is rigidly secured to the plate members 31 and movable therewith. A longitudinally extending plough member 102 is mounted to channel members 101 substantially along the longitudinal centerline of sections 14 and 16, preferably in a manner which permits the selective vertical adjustment thereof relative to carriage assembly 30. A roller assembly 103 is preferably secured at the leading edge of plough member 102 for contacting and infolding the leading bottom end flap of the setup carton in section 14 as the carriage assembly moves into its second position.

A pair of transversely spaced-apart carton receiving assemblies 104 is secured to and extends upwardly from carriage assembly 30, one on either side of plough member 102. Assemblies 104 comprise lower and upper spaced-apart longitudinally extending plates 105 and 106, which plates are secured together by spacing rods 107. Lower plates 105 are secured to channel members 101 in a suitable manner so as to permit selective transverse positioning thereof towards and away from plough member 102, as by clamp and guide assemblies 108 that are received in and ride along the channel members 101. A plurality of longitudinally spaced roller members 109 are journaled for rotation about the upper plate 106 so as to extend inwardly of the inner edge thereof. For reasons that will hereinbelow become more apparent, the leading roller 109 is preferably a brake roller for grasping the side panels of a setup carton.

A pair of converging side plough bars (not shown) is mounted to frame structure 18 within section 16 for infolding the bottom side flaps in a conventional manner.

The carton erector 10 of the present invention is provided with a pair of spaced-apart powered conveyor assemblies 140 that extend into section 16 for contacting the side panels of a setup carton and directing same therethrough so as to cause the bottom side flaps to contact plough bars (not shown) and to deliver the carton to a suitable bottom flap sealing apparatus (not shown). Referring to FIG. 1B, each conveyor assembly 140 is supported above a longitudinal channel frame member 142 in a suitable manner so as to permit selective longitudinal positioning and clamping of the conveyor assembly. Each channel frame member 142 is supported on a pair of spaced apart transverse frame members 144, which members are in turn supported for selective transverse movement with respect to a corresponding fixed channel frame member 146. In accordance with a preferred embodiment of the invention, frame member 144 may be transversely movable with respect to frame member 146 by a screw mechanism 148 having a handle 150, of a well known construction. The above structure permits the conveyor assemblies 140 to be longitudinally and transversely adjusted to accommodate different size cartons.

The sequential operation of the pneumatic cylinder assemblies 36, 64, 74, 96 are controlled by limit switches positioned on the frame structure to control power valves (not shown) in a conventional pneumatic circuit (not shown) in a manner which will hereinbelow become more apparent in the discussion of the operation of carton erector apparatus 10. A first limit switch 111 is suitably secured to the frame assembly 18 to control the retraction of the piston portion 68 of assembly 64 and thereby moves the folding arm assembly 44 from its first position (FIG. 2A) towards its second position (FIG. 3). Limit switch 111 also controls the extension of the pivot portion 78 of assembly 74 and thereby moves the pivot arm assembly 46 from its first position (FIG. 2A) towards its second position (FIG. 3). Limit switch 111 also opens the source of vacuum to the suction cup members 84, 122 and 128. Limit switch 111 is activated on contact with the upper edge of member 54 as folding arm assembly 44 moves into its first position (FIG. 1A).

A second limit switch is suitably secured to frame member 59 to control the extension of the piston portion 100 of assembly 96 and thereby moves the kicker plate 94 from its first position towards its second position. Limit switch 112 also controls the retraction of piston portion 40 of assembly 36 and thereby moves the carriage assembly 30 from its first position (FIG. 2B) towards its second position (FIG. 3). Limit switch 112 is activated by a pin member 114 rotatable with shaft 58, as the folding arm assembly 44 moves into its second position, as best seen in FIG. 3.

A third limit switch 115 is suitably secured to frame structure 18 for closing the source of vacuum to the suction cup member 84. Limit switch 115 also controls the retraction of piston portion 78 of assembly 74 and thereby moves the pivot arm assembly 46 from its second position (FIG. 3) towards its first position (FIG. 2A). Limit switch 115, after a short time delay, also controls the extension of piston portion 68 of assembly 64 and thereby moves the folding arm assembly 44 from its second position (FIG. 3) towards its first position FIG. 2A). Limit switch 115 is activated upon contact with an angle member or detente 116 secured to carriage plate 31, as best seen in FIGS. 1B and 2B.

A fourth limit switch 117 is suitably secured to frame structure 18 to control the extension of piston portion 40 of assembly 36 and thereby moves the carriage assembly 30 from its second position (FIG. 3) towards its first position (FIG. 2B). Limit switch 117 also controls the retraction of the piston portion 100 of assembly 96 and thereby moves the kicker plate 94 from its second position towards its first position. Limit switch 117 is activated upon contact with member 116, secured to carriage plate 31, as best seen in FIGS. 1B and 2B.

Figure 4:
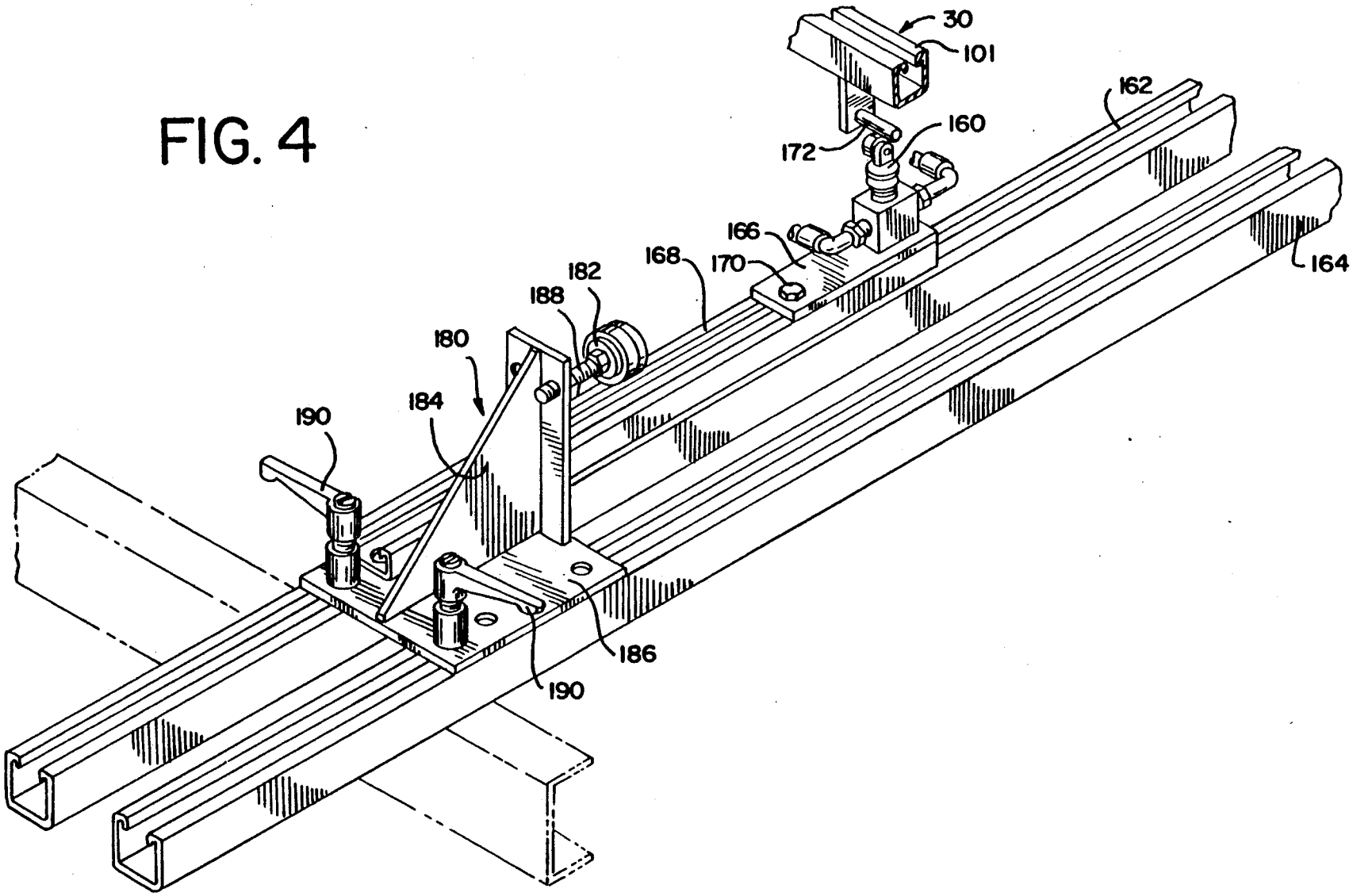
FIG. 4 is a perspective view of the assembly that controls the distance that the carriage assembly travels during each cycle.

A fifth limit switch 160 is provided to activate a speed control system (not shown) which may be provided in cooperation with assembly 36 to cushion the stopping of carriage assembly 30 as it returns to its first position. Referring to FIGS. 1B, 2B and 4, a pair of transversely spaced, longitudinally extending channel members 162 and 164 are supported in bottom flap folding section 16 below the path of travel of carriage assembly 30. Switch 160 is mounted to a plate 166 which in turn is mounted to a channel member 168 positioned above member 162. Plate 166 and channel member 168 are selectively movable along member 162, in a manner as hereinbelow described, so as to permit longitudinal positioning of switch 160. Limit switch 160 is activated by a detente 172 extending from a leading edge of carriage assembly 30.

A bumper assembly 180 is secured to channel member 168 and is also movable therewith. Bumper assembly 180 includes a bumper 182 that is mounted to a support structure 184, which in turn is secured to a plate 186. Bumper 182 includes a threaded shaft 188 that is suitably secured to structure 184 so as to permit adjustment of the longitudinal extension thereof towards switch 160. Plate 186 is secured to channel member 168. Plate 186 is mounted above channel members 162 and 164 and is longitudinally movable with respect thereto by loosening locking member 190 releasable securing plate 186 to members 162 and 164. Channel member 168 and switch 160 attached thereto and plate 186 and bumper 182 attached thereto longitudinally move as a unit within section 16.

Referring to FIGS. 1B and 2B, a shock absorber assembly 192 is secured to and extends outward from the leading edge of carriage assembly 30 to contact structure 184 as carriage assembly returns to its first position immediately prior to bumper 182 contacting carriage assembly 30 to absorb the shock associated with the stopping of carriage assembly 30.

The carton erector 10 of the present invention is typically utilized in cooperation with a carton sealing apparatus for receiving the setup carton and sealing the bottom flaps. Such carton sealing apparatus receives the setup carton from the bottom flap folding section 16. Referring to FIGS. 1B and 2B, a spaced-apart powered convey assembly 140 extends into section 16 for contacting the side panels of a setup carton and directing same therethrough so as to cause the bottom side flaps to contact plough bars and to deliver the carton to a suitable bottom flap sealing apparatus (not shown).

The operating cycle of erector apparatus 10 will now be described by tracing the passage of a carton 22 through the apparatus.

To prepare the apparatus for operation, the magazine assembly 20 is loaded with a plurality of knocked-down carton blanks which are inserted in the magazine so that they are all vertically oriented and aligned in the same direction. The carton blanks are aligned in such a direction that their side panels have an end fold at the left, as shown in FIG. 2A. In setting up the apparatus, the magazine assembly 20 is set up to accommodate the overall width of the knocked-down carton blanks in a well-known manner. The magazine assembly 20 is suitably adjusted to present the carton blanks to the carton setup section 14 so that the bottom fold lines of the cartons (which will be at the carton bottom when the bottom flaps are subsequently infolded) will be at the same height as the kicker plate 94 when it is in its horizontal position. The assemblies 104 are suitably adjusted for receipt of the specific carton size loaded in the magazine assembly 20. The folding arm 48 is adjusted relative to the support members 54 to align the longitudinal centerline of the setup carton with the plough member 102. The suction cup member 128 is adjusted such that a vertical plane passing through the face of the suction cup portion 130 is spaced from a vertical plane passing through the face of the suction cup portions 90, when the pivot arm 70 is in its second position, by a distance substantially equal to the width of the erected carton. The conveyor assemblies 140 are transversely and longitudinally adjusted dependent upon the length and width of the erected carton. Bumper assembly 180 is adjusted dependent upon the length of the erected carton.

At the start of the operating cycle, the apparatus 10 is positioned as shown in FIGS. 1A, 1B, 2A and 2B. That is, the carriage assembly 30, the folding assembly 44 and the pivot arm assembly 46 are in their first positions, and the kicker plate 94 is in its vertical or first position. Also the member 54 is in activating contact with switch 111.

With apparatus 10 so positioned, upon turning the apparatus to the "on" position, a source of vacuum is supplied to the suction cup members 84, 122 and 128 which causes the suction cups 90 to grasp the side panel of the forward carbon blank in the magazine assembly 20. Simultaneously therewith, the folding arm assembly 44 and the pivot arm assembly 46 are moved into their second positions by the respective cylinder assemblies 64 and 74, in the manner as hereinabove discussed, as is shown in solid lines in FIG. 3. As the folding arm assembly 44 and pivot arm assembly move into their second positions, the leading carton blank is pulled from the magazine assembly 20 inwardly into the carton setup section 14 by the inward movement of suction cups 90 in grasping contact with the side panel of the carton. The pivotal movement of the folding arm 48 causes surface 50 to contact the trailing end flap of the carton and open the carton blank into a tubular setup form as the folding arm assembly 44 and the pivot arm assembly simultaneously reach their second positions. As the carton reaches its tubular setup form, suction cup portion 124 grasps an end panel of the carton and suction cup portion 130 grasps the other side panel. In so doing, the carton is cradled between the suction cup portions 90, 124, and 130 to maintain the carton in a rectangular setup form during the entire erection cycle.

As the folding arm assembly 44 reaches its second position, pin member 114 contacts and activates switch 112, which simultaneously causes cylinder assembly 96 to move the kicker plate 94 to its horizontal second position, infolding the trailing bottom end flap, and the cylinder assembly 36 to start movement of the carriage assembly 30 into its second position towards carton setup section 14 so as to infold the leading end flap as it contacts plough member 102 and to receive and grasp the setup carton between the rollers 109 of assemblies 104. Activation of switch 112 also deactivates the speed control system associated with cylinder assembly 36.

As the carriage assembly 30 approaches its second position, detent 116 contacts and activates switch 115 controlling the initiation of a series of operations. The source of vacuum to the suction cup member 84, 122, and 128 is shut off, releasing the setup carton to the rollers 109. The cylinder assembly 74 initiates the movement of the pivot arm assembly 46 to return to its first position and, after a short time delay, controls cylinder assembly 64 so as to move the folding arm assembly 44 from its second position to its first position.

As the carriage assembly 30 reaches its second position, detent 116 contacts and activates switch 117 controlling the initiation of a series of operations. The cylinder assembly 36 initiates the movement of carriage assembly 30 from its second position to return to its first position delivering a setup carton into bottom flap folding section 16. The setup carton is received by the conveyor assemblies 140 for delivery of the carton through section 16. As the setup carton travels through section 16, the side plough members (not shown) contact and infold the side bottom flaps of the setup carton. Activation of switch 117 also controls cylinder assembly 96 so as to return kicker plate 94 from its second position to its first position.

As the carriage assembly 30 returns to its first position, detent 172 contacts and activates a speed control system (not shown) to cushion the stopping of the carriage assembly. The shock absorber assembly 192 contacts structure 184 to further cushion the stopping of the carriage assembly prior to its being stopped as it contacts bumper 182. As the folding assembly 44 return to its first position, switch 111 is activated and the components of the carton erector assembly are in their initial position ready to grasp the next carton blank and repeat the operating cycle.

It should be noted that the selective longitudinal positioning of the unit comprising the switch 160 and the bumper 182 is effective to alter the distance that the carriage assembly travels into the bottom flap folding section 16. Further, the conveyor assemblies 140 are adjusted, as hereinabove discussed, dependent upon the selected carriage assembly travel distance and the length and width of the erected carton.

Thus, there has been described a novel erecting apparatus which facilitates the setting up of knocked-down carton blanks. Although the invention has been described with the requisite degree of particularity, it is understood that the present disclosure has been made only by way of example and that numerous changes in the details of construction and the combination and arrangement of parts may be resorted to without departing the from spirit and scope of the invention as hereinafter claimed.

What is claimed is:

1. Carton erecting apparatus for setting up and bottom closing of cartons which are supplied to the apparatus as knocked-down carton blanks having side and end panels and top and bottom flaps formed integral therewith; said apparatus comprising:

(a) a carton blank storage section having a magazine means for storing and urging knocked-down carton blanks towards a carton set-up section positioned adjacent to said carton blank storage section;

(b) said carton set-up section including a carton opening assembly for receiving a carton blank from said magazine means and setting up said carton blank in a tubular form;

(c) said apparatus having a bottom flap folding section positioned adjacent said carton set-up section, said bottom flap folding section having a bottom flap folding means associated therewith for infolding the bottom flaps of the set-up carton;

(d) a carriage assembly having a substantially horizontal carriage plate mounted in said bottom flap folding section for movement through a substantially horizontal plane by first means connected to said carriage plate between a first position within said bottom flap folding section and a second position extending into said carton set up section and comprising means for receiving and delivery of the set-up carton into said bottom flap folding section without interfering with the operation of said carton opening assembly; and (e) control means for contacting and selectively stopping the travel of said carriage assembly at locations in said bottom flap folding section and thereby controlling the distance said carriage assembly travels into said bottom flap folding section when it reaches its first position.

2. The invention as defined in claim 1 wherein said control means includes a switch means that activates said first means, said switch means being mounted so as to permit selective adjustment thereof along the path of travel of said carriage assembly.

3. The invention as defined in claim 1 including a pair of spaced apart conveyor assemblies for receiving the set-up carton and directing it through said bottom flap folding section, said conveyor assemblies being traversely adjustable towards and away from each other and longitudinally adjustable within said bottom flap folding section.

4. The invention as defined in claim 1 wherein said control means includes a bumper member assembly positioned in said bottom flap folding section to contact and stop said carriage assembly as it reaches its first position, said bumper member assembly being mounted so as to permit selective adjustment thereof along the path of travel of said carriage assembly.

5. The invention as defined in claim 4 further including a chock absorber member secured to said carriage assembly so as to contact said bumper member assembly immediately prior to said carriage assembly contacting said bumper member assembly so as to cushion the stopping of said carriage assembly in its first position.

* * * * *